US005395270A

United States Patent [19]

Jinno et al.

[11] Patent Number: 5,395,270

[45] Date of Patent: Mar. 7, 1995

[54] WEAK MATING FORCE FEMALE TERMINAL

[75] Inventors: Keishi Jinno; Haruki Yoshida, both of Shizuoka, Japan

[73] Assignee: Yazaki Corporation, Japan

[21] Appl. No.: 128,296

[22] Filed: Sep. 29, 1993

[30] Foreign Application Priority Data

Oct. 1, 1992 [JP] Japan ..... 4-068652 U

[51] Int. Cl.[6] ..... H01R 11/22

[52] U.S. Cl. ..... 439/850

[58] Field of Search ..... 439/842, 843, 849, 850, 439/851, 858, 862, 877

[56] References Cited

U.S. PATENT DOCUMENTS

| | | | |
|---|---|---|---|
| 3,644,872 | 2/1972 | Russo, Jr. | 439/849 |
| 3,660,806 | 5/1972 | De Stephan | 439/849 X |
| 3,729,701 | 4/1973 | Smith | 439/849 |
| 4,423,921 | 1/1984 | Hall | 439/849 |
| 5,295,875 | 3/1994 | Yoneda et al. | 439/850 |

FOREIGN PATENT DOCUMENTS

| | | | |
|---|---|---|---|
| 53-133192 | 10/1978 | Japan . | |
| 54-137191 | 9/1979 | Japan . | |
| 54-171785 | 12/1979 | Japan . | |
| 56-73U | 1/1981 | Japan . | |
| 58-176378 | 11/1983 | Japan . | |
| 58-184783 | 12/1983 | Japan . | |
| 60-7007Y2 | 3/1985 | Japan . | |
| 1309769 | 3/1973 | United Kingdom | 439/845 |

*Primary Examiner*—William Briggs

*Attorney, Agent, or Firm*—Wigman, Cohen, Leitner & Myers

[57] ABSTRACT

In a weak mating force female terminal formed with a base plate portion; a pair of elastic curled portions extending from both side ends of the base plate portion so as to be folded over an inner surface of the base plate portion; and a pair of electric contact portions each extending from a middle end of the elastic curled portion so as to be bent outwardly along the inner surface of the base plate portion at an inner end of the elastic curled portion, in particular each of the elastic curled portions is formed with a primary inclined guide portion extending upwardly and outwardly toward a male terminal insertion opening at an outer end of the elastic curled portion; each of the electric contact portions is formed with a secondary inclined guide portion extending upwardly so as to intersect the primary inclined guide portion of the elastic curled portion at an outer end of the electric contact portion; and a pair of thirdly inclined guide portions each of which is disposed between a base of said primary inclined guide portion and a base of said secondary inclined guide portion and extends upwardly.

5 Claims, 7 Drawing Sheets

WEAK MATING FORCE FEMALE TERMINAL

BACKGROUND OF THE INVENTION

The present invention relates to a weak mating force female terminal, and more specifically to a female terminal with which a mated male (tab) terminal can be mated smoothly by a weak mating force.

An example of a prior art female terminal is disclosed in Japanese Published Unexamined (Kokai) Utility Model Application No. 56-73, as shown in FIGS. 1A and 1B. FIG. 1A is a perspective view showing the prior art female terminal, and FIG. 1B is a cross-sectional view showing the same, taken along the line 1B—1B in FIG. 1A.

In these drawings, the female terminal 21 is formed with roughly a base plate portion 22, a pair of eyeglass-shaped curled elastic contact portions 23 and a wire clipping portion 24. The elastic contact portions 23 are formed on the outer (front) side of the base plate 22 and the wire clipping portion 24 is formed on the inner (rear) side of the base plate 22. Each of the elastic contact portions 23 is formed by bending an elastic curled portion 25 extending from both side ends of the base portion 22 toward the base portion 22 and further bending the elastic curled portion 25 along the inner surface of the base portion 22 to form an electric contact portion 26 with a space between the electric contact portion 26 and the base plate 22. Further, the outer end of the electric contact portion 26 is slightly bent outward so as to form an inclined guide portion 27 for guiding an end of a mated male tab terminal 2.

In mating these female terminal 21 with the male terminal 2, the end of the male tab terminal 2 is guided along the inclined guide portions 27 and further inserted into the spaces formed between the electric contact portions 26 and the inner surface of the base plate 22, in such a way that the male tab terminal 2 is brought into contact between the electric contact portions 26 and the base plate 22.

In the above-mentioned structure of the prior-art female terminal, however, in the case where a great number of female terminals are housed within a connector housing (not shown), since the mating force required to mate the male terminals with the female terminals inevitably increases, there exists a problem in that the terminal mating or connector engaging workability is deteriorated. In addition, since the inclined guide portion 27 is formed by simply bending the outer end of the electric contact portion 26 outwardly, it is impossible to guide the end of the male tab terminal 2 reliably.

SUMMARY OF THE INVENTION

With these problems in mind, therefore, it is the primary object of the present invention to provide a female terminal weak in the mating force required when mated with the male terminal and further excellent in the male terminal guiding capability.

To achieve the above-mentioned object, a weak mating force female terminal according to the present invention comprises: a base plate portion; a pair of elastic curled portions formed integral with said base plate portion and extending from both side ends of said base plate portion so as to be folded over an inner surface of said base plate portion, each of said elastic curled portions being formed with a primary inclined guide portion extending upwardly and outwardly toward a male terminal insertion opening at an outer end of said elastic curled portion; a pair of electric contact portions, each formed integral with said elastic curled portion and extending from a middle end of said elastic curled portion so as to be bent outwardly along the inner surface of said base plate portion at an inner end of said elastic curled portion, each of said electric contact portions being formed with a secondary inclined guide portion extending upwardly so as to intersect the primary inclined guide portion of said elastic curled portion at an outer end of said electric contact portion; and a pair of thirdly inclined guide portions each of which is disposed between a base of said primary inclined guide portion and a base of said secondary inclined guide portion and extends upwardly.

Further, the base plate portion is preferably formed with a pair of inwardly projecting portions at such positions as to be opposed to a pair of said electric contact portions. Each of said inwardly projecting portions is preferably formed with a sloped guide portion at an outer end of said inwardly projecting portion to guide an end of a mated male terminal.

In the female terminal of the present invention, since the length of the electric contact portion is reduced as compared with that of the conventional female terminal, it is possible to reduce the terminal mating force. Further, since the primary inclined guide portion is formed in place of the electric contact portion, it is possible to smoothly guide the male tab terminal in cooperation with the secondary inclined guide portion. The female terminal of the present invention is advantageous in particular when the number of the connector terminals is large, because the female and male connectors can be engaged with each other smoothly by a weak force.

DETAILED DESCRIPTION OF THE PREFERRED EMBODIMENT

FIRST EMBODIMENT

Figure 1A:
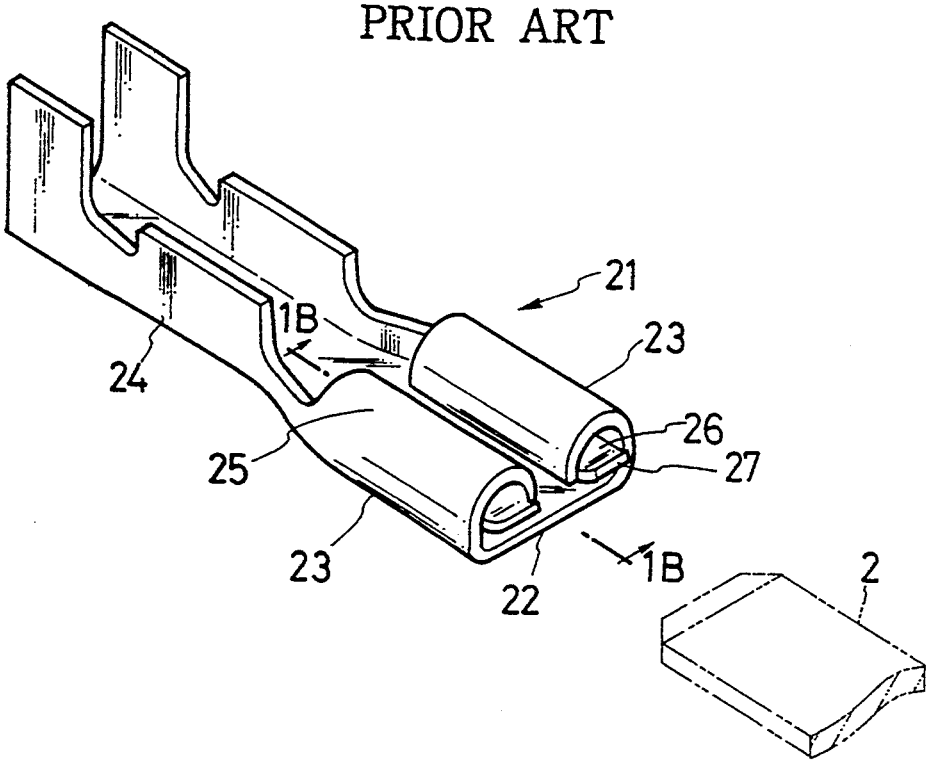
FIG.1A PRIOR ART
FIG. 1A is a perspective view showing a conventional female terminal mated with a male terminal.
Figure 1B:
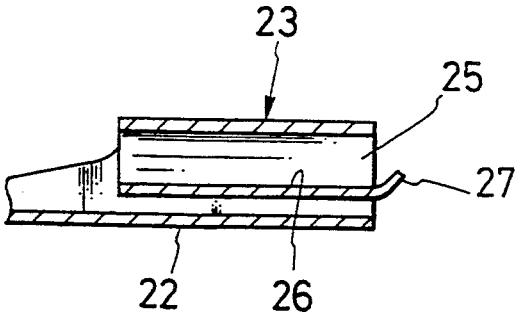
FIG.1B PRIOR ART
FIG. 1B is a cross-sectional view taken along the line 1B—1B in FIG. 1A.
Figure 2:
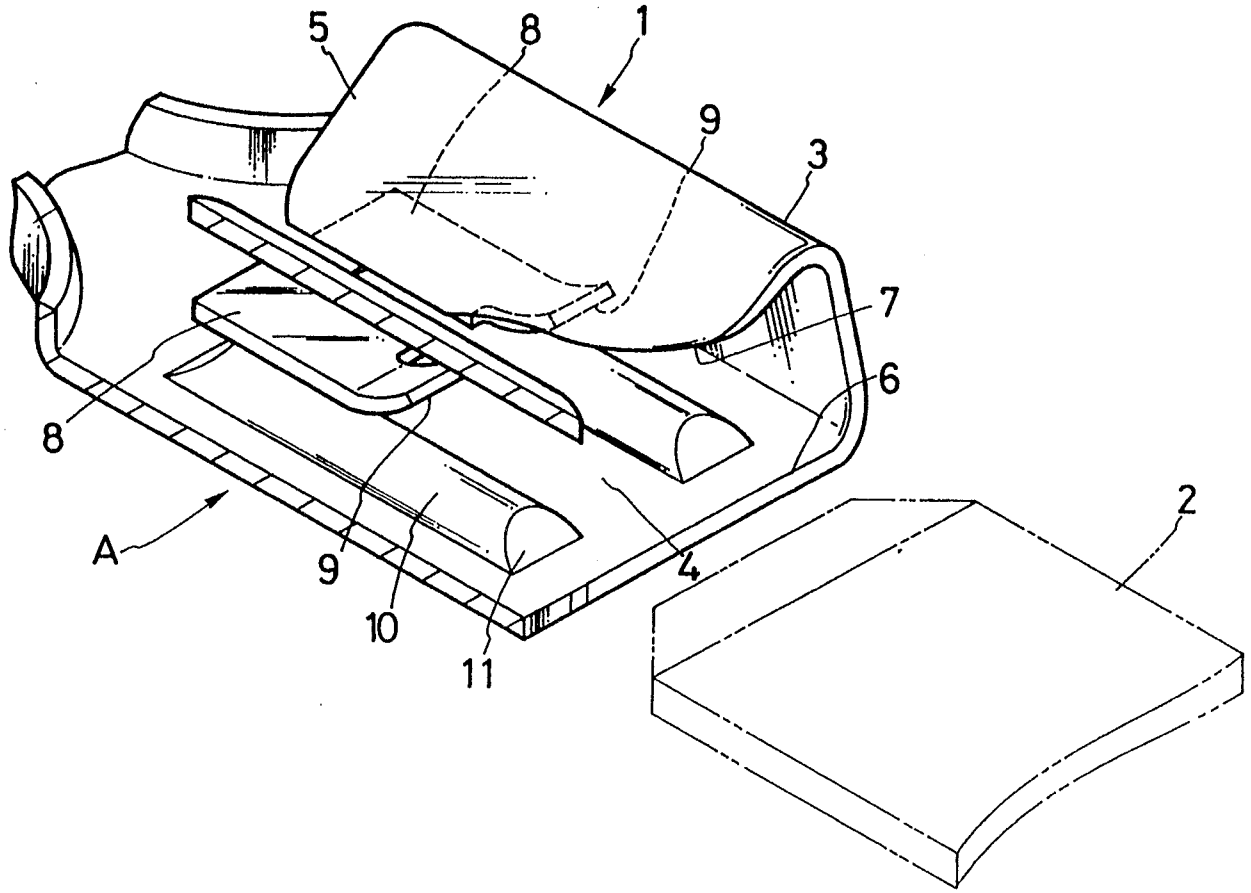
FIG. 2 is a perspective, partially broken view showing an embodiment of the weak mating force female terminal according to the present invention.
Figure 3:
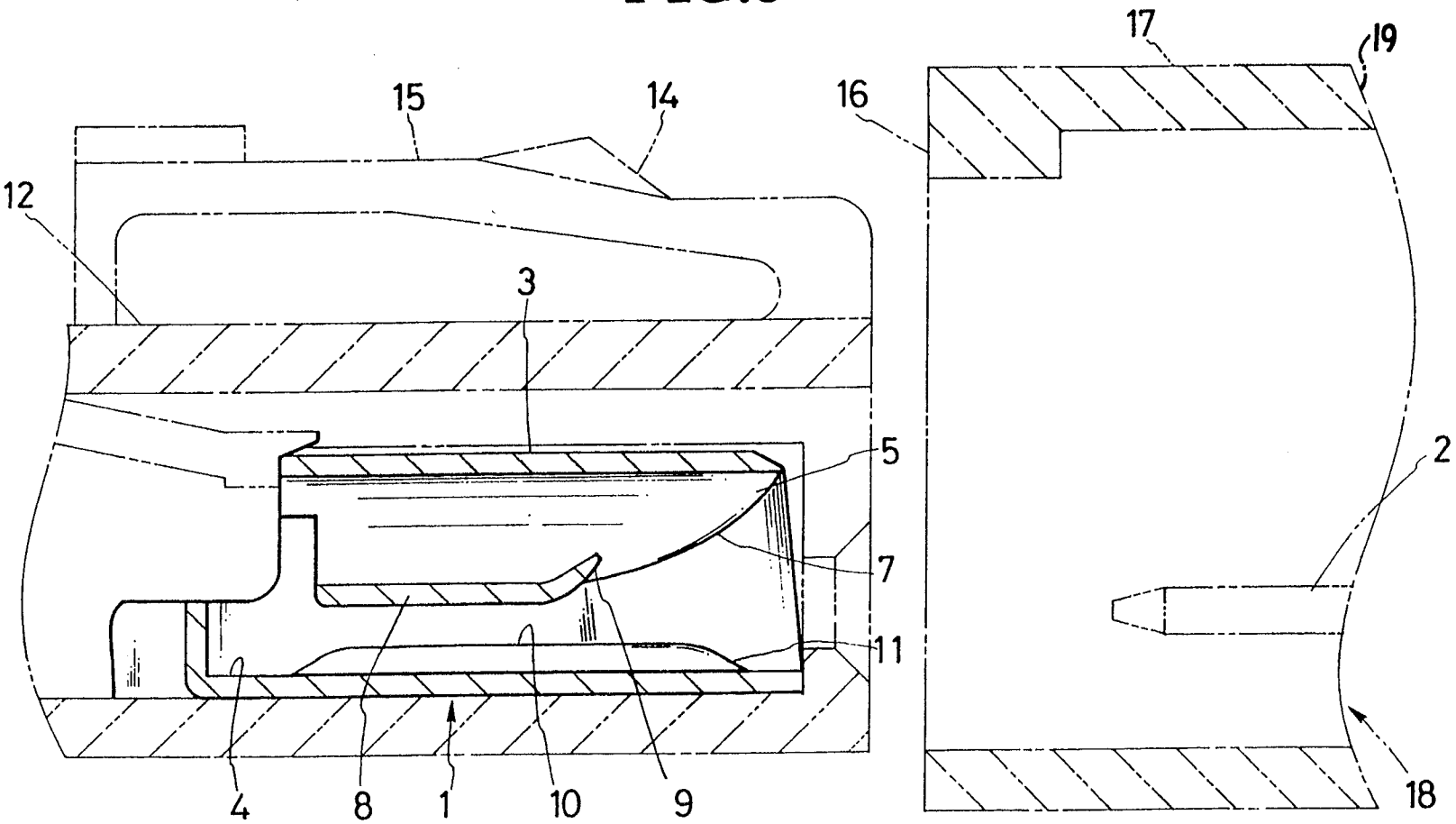
FIG. 3 is an enlarged cross-sectional view showing the weak mating force female terminal housed within a female connector housing, obtained when seen from the arrow direction A in FIG. 2.
Figure 4:
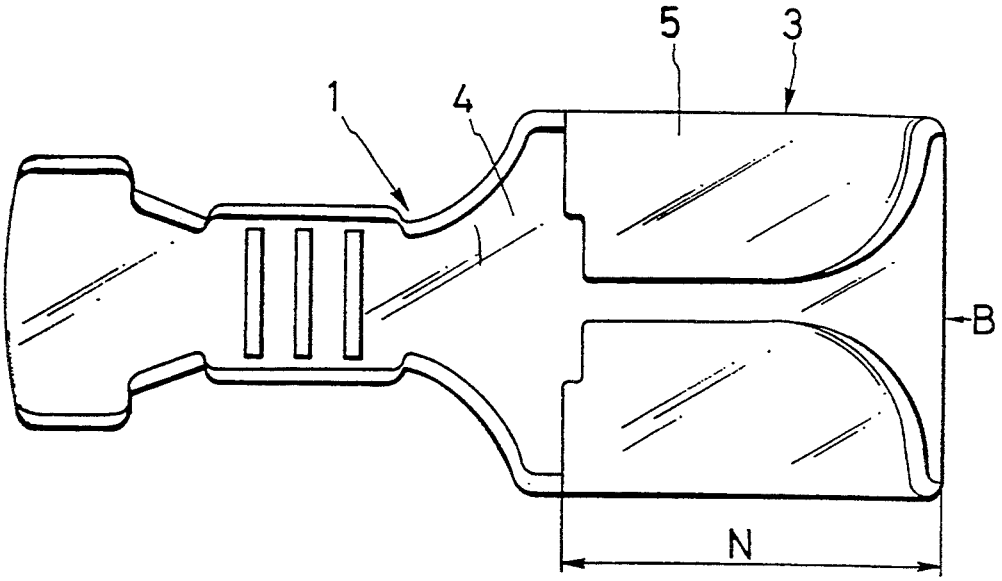
FIG. 4 is a plane view showing the same female terminal, obtained when seen from above.
Figure 5:
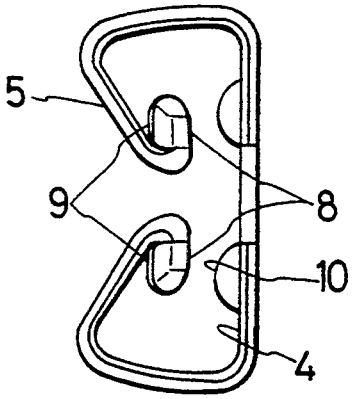
FIG. 5 is a front view showing the same female terminal, obtained when seen from the arrow direction B in FIG. 4.

The first embodiment of the weak mating force female terminal according to the present invention will be described hereinbelow with reference to the attached drawings, in which FIG. 2 is a perspective, partially broken view showing the female terminal; FIG. 3 is a cross-sectional view showing the female terminal housed within a male connector housing; FIG. 4 is a plane view showing the same; and FIG. 5 is a front view showing the same.

The feature of the weak mating force female terminal 1 according to the present invention resides in the shape of the elastic contact portion 3 brought into contact with a male tab terminal 2.

In more detail, the female terminal 1 is formed with a base plate portion 4 and a pair of elastic contact portions 3 extending from both side ends of the base plate portion 4. Each of the elastic contact portions 3 is formed with an elastic curled portion 5 formed integral with the base plate portion 4 and extending from each side portion of the base plate portion 4 so as to be folded over an inner surface of the base plate portion 4. Further, each of the elastic contact portion 3 is formed with an electric contact portion 8 formed integral with the elastic curled portion 5 and extending from a middle end of the elastic curled portion 5 so as to be bent outwardly along the inner surface of the base plate portion 4 at an inner end of the elastic curled portion 5.

Further, each of the elastic curled portion 5 is formed with a primary inclined guide portion 7 extending upwardly and outwardly toward a male terminal insertion opening 6 at an outer end of the elastic curled portion 5. Each of the electric contact portion 8 is formed with a secondary inclined guide portion 9 extending upwardly so as to intersect the primary inclined guide portion 7 of the elastic curled portion 5 at an outer end of the electric contact portion 8.

In addition, the base plate portion 4 is formed with a pair of electric semicylindrical inwardly projecting contact portions 10 extending longitudinally from the male terminal insertion opening portion 6 at such positions as to be opposed to the electric contact portions 8 and with a pair of sloped guide surface portions 11 at such positions as to be opposed to the primary inclined guide portions 7.

As shown in FIG. 3, the female terminal 1 thus constructed is housed within a synthetic resin male connector housing 12, and mated with a male tab terminal 2 disposed within a female connector housing 19. The male connector housing 12 is formed with a flexible lock arm 15 having a sharply sloped engage projection 14 on the outer wall of the male connector housing 12. The female housing 13 is formed with an engage frame 17 having a vertical contact surface 16 engaged with the sloped engage projection 14.

When the male connector housing 12 is engaged with the female connector housing 19, the lock arm 15 is engaged with the engage frame 17 by a relatively strong pushing force. At this time, the male tab connector terminal 2 is mated with the female connector terminal 1 by the force of inertial generated when the two connector housings 12 and 13 are engaged.

Figure 6:
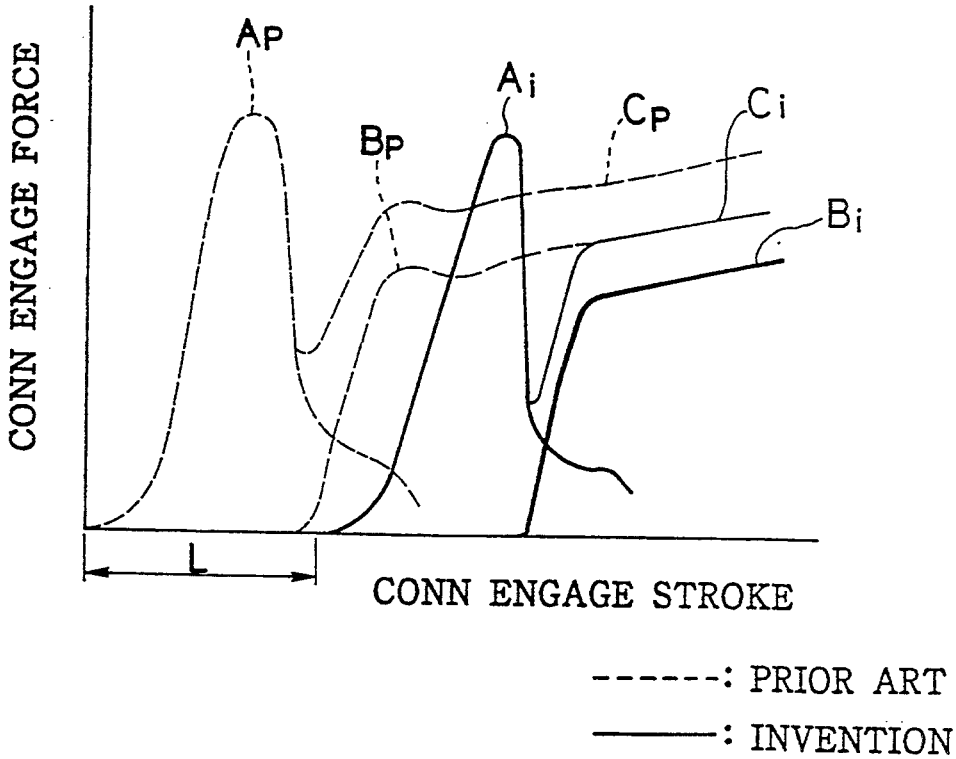
FIG. 6 is a graphical representation showing the relationship between the connector engaging force and the connector engaging stroke in comparison between the prior art connector (dashed lines) and the invention connector (solid lines)

FIG. 6 shows the relationship between the male and female connector engaging force and the connector engaging stroke, in which the dashed lines indicate the prior art connector and the solid lines indicate the connector of the present invention. Further, in FIG. 6, the clashed line Ap represents a force required to lock the prior art connector housings, and Ai represents a force required to lock the connector housing of the present invention. The dashed line Bp shows a force required to mate the prior art connector terminals, and the solid line Bi shows a force required to mate the connector terminals of the present invention. The dashed line Cp indicates a resultant force of the prior art connector terminal and housing, and the solid line Ci indicates a resultant force of the connector terminal and housing of the present invention.

As clearly shown in FIG. 6, there exists a difference L in the connector stroke between the prior art and the invention. In the weak mating force female terminal according to the present invention, since the length of the electric contact portion 8 is reduced as compared with that of the prior art female terminal, the male tab terminal 2 is inserted into the female connector terminal 1, without contact with the electric contact portion 8, between the primary inclined guide portions 7 and the sloped guide portions 11 near the male terminal insertion opening 6 of tile elastic contact portion 3. Accordingly, there exists an excessive stroke L (see FIG. 6) before the start of the connector housing locking. In other words, it is possible to reduce the overall longitudinal length of the female connector housing 19 by this length L; that is, to compact the connector 18 by the length L corresponding thereto. Further, since the sliding and contacting surface between the electric contact portion 8 and the male tab terminal 2 is relatively small in area, it is possible to reduce the mating force of both the terminals. Accordingly, the connector engaging workability can be improved. In addition, since the terminal mating force and the connector engaging stroke can be both reduced, it is possible to improve the workers' connector lock feeling due to the force of inertial generated when the connector housings are engaged.

In particular, since the female terminal 1 of the present invention is formed with a primary inclined guide portion 7 and a secondary inclined guide portion 9, the end of the male tab terminal 2 can be guided continuously by the primary inclined guide portion 7 and then the secondary inclined guide portion 9, it is possible to smoothly mate the male tab terminal 2 with the female terminal 1; that is, to engage the male connector housing with the female connector housing. In addition, since the male tab terminal 2 is brought into surface contact with the electric contact portion 8 and the longitudinal length N (see FIG. 4) of the elastic curled portion 5 is sufficiently long as in the prior art female terminal, the elastic force is sufficient and thereby it is possible to secure a reliable electric connection between the male and female terminals.

SECOND EMBODIMENT

The second embodiment of the present invention will be described with reference to FIGS. 7 to 10 hereinafter.

Figure 9:
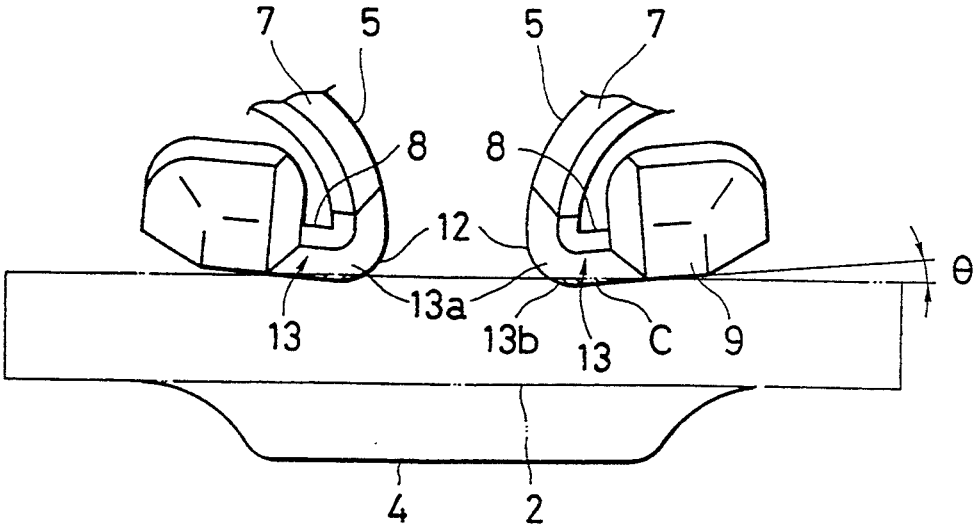
FIG. 9 is a front view showing the inclined guide shown in FIG. 7.

A weak mating force female terminal 1 of the present invention, as well as the first embodiment, has a base plate portion 4, a pair of elastic curled portions 5, 5, and a pair of electric contact portions 8, 8. A pair of electric contact portions 8, 8 are tips of a pair of elastic curled portions 5, 5 and are slightly upwardly bent at an angle $\theta$ (FIG. 9). Since whole configuration of the second embodiment is basically the same as that of the first embodiment, duplicated explanation is omitted.

In this embodiment, inclined guides 13, 13 are formed on front end portions 12*a*, 12*a* of folded portions 12. The inclined guides 13, 13 have tapered surfaces 13*a*, 13*a* each of which faces the base plate portion 4. The folded portion 12 is arranged between the elastic curled portion 5 and the elastic contact portion 8.

Figure 7:
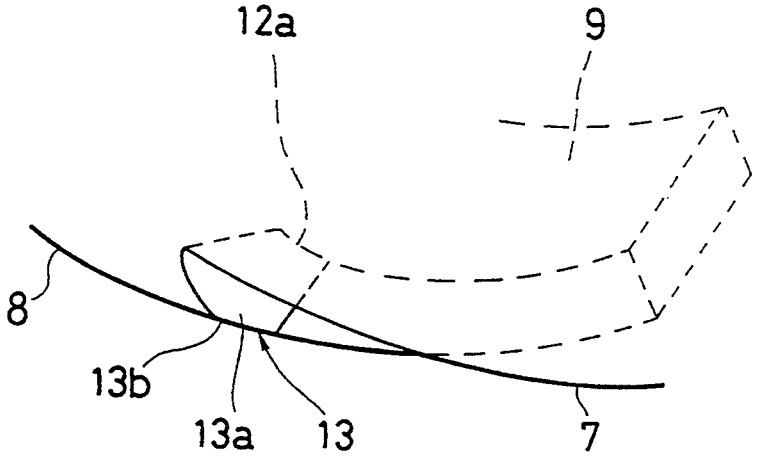
FIG. 7 is a expanded view showing an inclined guide in the second embodiment.
Figure 8:
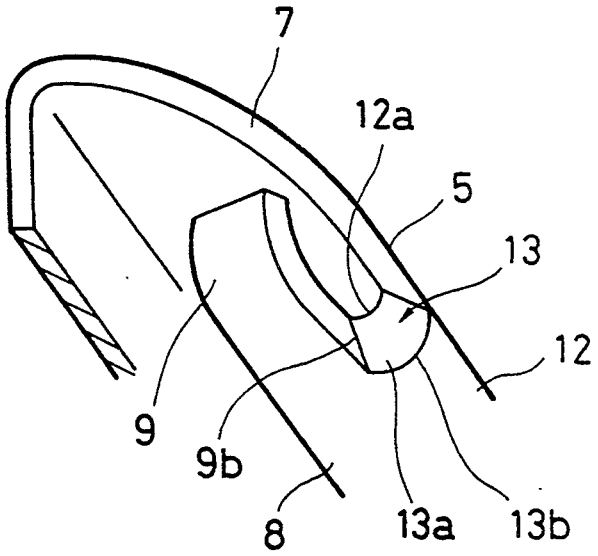
FIG. 8 is a base perspective view showing the inclined guide shown in FIG. 7.

As shown in FIGS. 7, 8, the above mentioned inclined guide 13 has the tapered surface 13*a* which is almost fan shape like and faces downward. The tapered surface 13*a* is extended from a base portion 9*b* of a front inclined guide portion 9 to the elastic curled portion 5. The outer end portion 13*b* of the tapered surface 13*a* leads smoothly to the folded portion 12 of the electric contact portion 8 without a burr and the like.

It is possible to smoothly slide and contact a male tab terminal 2 (FIG. 9) from a front (primary) inclined guide portion 7 through the front (secondary) inclined guide portion 9 to the (thirdly) inclined guide 13 of the folding front end portion 12*a*. In FIG. 9, a slashed area C indicates a slide-contact portion of the inclined guide 13 and the tab terminal 2.

The electric contact portion 8 has an initial shape which upwardly inclines at an angle $\theta$ to the base plate portion 4. Therefore, it is possible for the electric contact portion 8 to flatly come in contact with the tab terminal 2 when the elastic curled portion 5 is outwardly and elastically bent by the insertion of the tab terminal 2.

Figure 10:
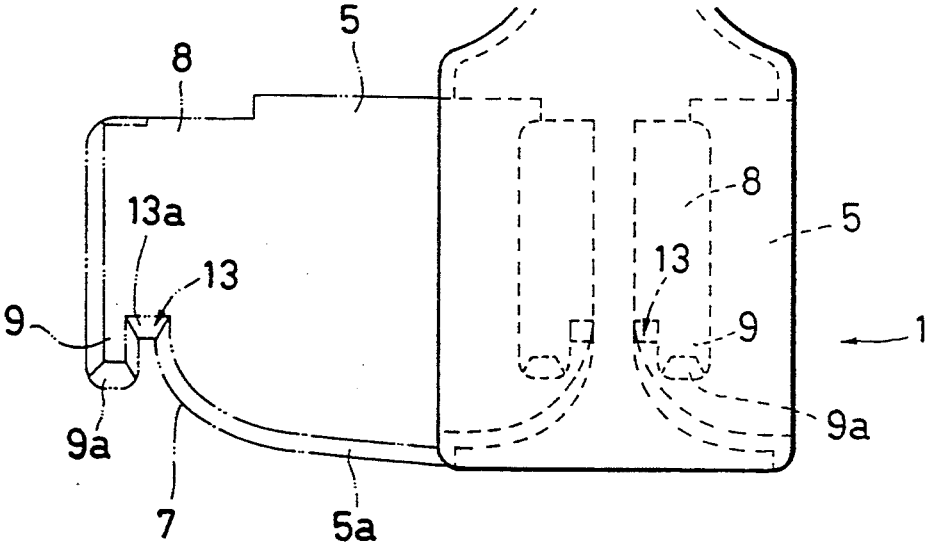
FIG. 10 is a top plane view and one side expanded view of the weak mating force female terminal according to the second embodiment.

FIG. 10 is a top plane view and one side expanded view of the above mentioned weak mating force female terminal 1.

At the next stage of a blank stage of the terminal 1, the inclined guide 13 in this embodiment is formed in a tapered shape by being hit together with front end edges 5*a*, 9*a* of the elastic curled portion 5 and the front inclined guide 9. At the same time, an end surface burr at the blanking is removed as well. The front end tapered portion 9*a* of the front inclined guide portion 9 increases the ability of guidance for the tab terminal 2. The front end tapered portion 5*a* of the elastic curled portion 5 increases the ability of insertion of the terminal 1 into a connector housing which is not shown in figures. Further, this embodiment has the same effects as that of the first embodiment formerly described.

As described above, in the weak mating force female terminal according to the present invention, since the male tab terminal can be mated with the female terminal smoothly and reliably by a relatively weak force, in particular when the number of connectors increases, it is possible to improve the connector engaging workability and the connector engaging feeling.

What is claimed is:

1. A weak mating force female terminal, comprising:

a base plate portion;

a pair of elastic curled portions formed integral with said base plate portion and extending from both side ends of said base plate portion so as to be folded over an inner surface of said base plate portion, each of said elastic curled portions being formed with a primary inclined guide portion extending upwardly and outwardly toward a male terminal insertion opening at an outer end of said elastic curled portion;

a pair of electric contact portions each formed integral with said elastic curled portion and extending from a middle end of said elastic curled portion so as to be bent outwardly along the inner surface of said base plate portion at an inner end of said elastic curled portion, each of said electric contact portions being formed with a secondary inclined guide portion extending upwardly so as to intersect the primary inclined guide portion of said elastic curled portion at an outer end of said electric contact portion; and a pair of thirdly inclined guide portions each of which is disposed between a base of said primary inclined guide portion and a base of said secondary inclined guide portion and extends upwardly.

2. The weak mating force female terminal according to claim 1, wherein said base plate portion is formed with a pair of inwardly projecting portions at such positions as to be opposed to a pair of said electric contact portions.

3. The weak mating force female terminal according to claim 2, wherein each of said inwardly projecting portions is formed with a sloped guide portion at an outer end of said inwardly projecting portion to guide an end of a mated male terminal.

4. The weak mating force female terminal according to claim 1, wherein each of said thirdly inclined guide portion has a tapered surface which faces said base plate portion.

5. The weak mating force female terminal according to claim 4, wherein said tapered surface has a fan shape.

* * * * *